US006162158A

United States Patent [19]

Mercer et al.

[11] Patent Number: 6,162,158

[45] Date of Patent: Dec. 19, 2000

[54] METHOD OF FABRICATING A SLEEVE LABEL WITH MULTILAYERED INTEGRAL FLAPS

[75] Inventors: Joseph B. Mercer, Hickory; Quy Thai, Conover, both of N.C.

[73] Assignee: Plastic Packaging Inc., Hickory, N.C.

[21] Appl. No.: 09/342,476

[22] Filed: Jun. 29, 1999

[51] Int. Cl.[7] ..... B31C 11/02

[52] U.S. Cl. ..... 493/288; 493/302; 493/357; 493/961; 493/346; 493/375

[58] Field of Search ..... 493/270, 302, 493/269, 342, 357, 356, 961, 198, 230, 238, 233, 288, 375, 346; 156/227

[56] References Cited

U.S. PATENT DOCUMENTS

| | | | |
|---|---|---|---|
| 577,804 | 2/1897 | Wittemann . | |
| 2,091,346 | 8/1937 | Wright . | |
| 2,420,045 | 5/1947 | Krug . | |
| 3,444,792 | 5/1969 | Thesing et al. | 93/35 |
| 3,702,511 | 11/1972 | Miller . | |
| 3,863,373 | 2/1975 | Kaercher et al. | 40/306 |
| 4,312,523 | 1/1982 | Haines . | |
| 4,325,762 | 4/1982 | Burmeister et al. . | |
| 4,446,616 | 5/1984 | Waterman . | |
| 4,767,393 | 8/1988 | Smith | 493/342 |
| 4,817,882 | 4/1989 | Brewer, Sr. et al. | 242/56 R |
| 5,074,595 | 12/1991 | Hill et al. | 283/81 |
| 5,207,458 | 5/1993 | Treichel et al. . | |
| 5,237,799 | 8/1993 | Van Boxtel | 53/426 |
| 5,241,743 | 9/1993 | Hubbs et al. . | |
| 5,422,152 | 6/1995 | Langeland et al. . | |
| 5,575,096 | 11/1996 | Allegre . | |
| 5,643,383 | 7/1997 | Allegre | 156/203 |
| 5,658,015 | 8/1997 | Allegre | 283/70 |
| 5,897,722 | 4/1999 | Bright | 156/86 |
| 5,945,183 | 8/1999 | Johnson | 428/34.9 |

FOREIGN PATENT DOCUMENTS

| | | |
|---|---|---|
| 755867A1 | 1/1997 | European Pat. Off. . |
| 1043230 | 11/1953 | France . |
| 2682320 | 4/1993 | France . |
| 2699716 | 8/1994 | France . |
| 3924790A1 | 2/1991 | Germany . |
| 2029369A | 8/1978 | United Kingdom . |

*Primary Examiner*—Stephen F. Gerrity
*Assistant Examiner*—Sam Tawfik
*Attorney, Agent, or Firm*—Alston & Bird LLP

[57] ABSTRACT

A sleeve label is fabricated from a sheet of polymeric material which is folded upon itself along at least three longitudinal fold lines, with the resulting four overlying layers then being joined together along a longitudinal seal line. The two outermost layers are longitudinally slit along the third fold line. The resulting structure forms a closed tube formed by the first two overlying layers, and two overlying separate flaps formed by the two outermost layers. By adding additional fold lines and additional slits, additional separate flaps can be formed to result in a structure in the nature of a multi-paged booklet.

12 Claims, 2 Drawing Sheets

1/2
10
12
LIFT TO OPEN 40
5
36
18
20
38
34
32

24
26
22
30
15
28
14
16
13

METHOD OF FABRICATING A SLEEVE LABEL WITH MULTILAYERED INTEGRAL FLAPS

BACKGROUND OF THE INVENTION

The present invention relates to a tubular sleeve of polymeric sheet material which is adapted for use as a sleeve label on a consumer product.

Many consumer products, such as plastic bottles and jugs, are directly printed with an identifying label and product information. However, it is difficult and costly to achieve high quality printing on such products, particularly in instances where it is necessary to utilize small print in order to provide detailed product information in a relatively small space.

As an alternative to direct printing, sleeve labels have become increasingly popular, since the plastic material of the sleeve can be more easily printed in a high quality manner, thus improving the attractiveness of the product to the consumer. Also, more product information can be supplied in a relatively small space because of the higher print quality.

Sleeve labels are fabricated by a process wherein a sheet of suitable polymeric material, usually low density polyethylene, is initially printed with the desired product identifying and descriptive information. The sheet is then advanced along a longitudinal path of travel, and it is folded upon itself so that the two side edges of the sheet overlie each other. The overlying side edges are then sealed together along a heated weld line or the like to form a tube. Also, transverse perforated tear lines are formed in the tube at longitudinal spaced apart locations so as to define the individual labels. The tube is then positioned above the consumer product, such as a bottle or package, and the gripper arms of an assembly machine reach into the tube to radially expand the lowermost label and pull it downwardly so as to separate it from the remainder of the tube along the transverse tear line. The gripped label is then brought into surrounding relation about the consumer product, and the gripper arms release the expanded label so that it contracts and is applied to the product.

Applicants co-pending application Ser. No. 09/006671 discloses an improved sleeve label which includes an outer flap or a small tubular header which is an integral part of the label, and which provides space for additional product information or which can be removed as a redeemable savings coupon for use by the consumer.

It is an object of the present invention to provide an improved sleeve label of the described type, as well as a method of fabricating the same.

SUMMARY OF THE INVENTION

The above and other objects and advantages of the present invention are achieved in the embodiments illustrated herein by the provision of a tubular sleeve which comprises a sheet of polymeric material having opposite side edges which are joined together along a longitudinal seal line to define a tube of sheet material. A plurality of overlying flaps of polymeric sheet material overlie at least a portion of the tube, with each of the flaps being secured to and extending from the seal line in a transverse direction. Each of the flaps terminates in a longitudinal outer edge which is transversely spaced from the seal line. Further, a portion of the outermost one of the overlying flaps which is adjacent the longitudinal outer edge thereof, is adhered to the tube, preferably by means of an adhesive bearing tape. In addition, a release strip may be adhered to a portion of the tape, so as to facilitate the release of the outermost flap.

The tubular sleeve of the present invention is fabricated by a method which comprises the steps of folding a sheet of polymeric material upon itself along at least three parallel longitudinally extending fold lines, so as to form at least four overlying layers of the sheet material. The overlying layers are joined to each other along a longitudinal seal line which is parallel to and adjacent at least one of the fold lines, and the sheet is longitudinally slit at a location adjacent a fold line other than the one fold line. Accordingly, two of the layers of the folded sheet material form a tube and two of the overlying layers form two overlying flaps which extend transversely from the seal line.

The sleeve label is preferably initially formed as part of a continuous tube, with the continuous tube having transverse severance lines formed thereon at longitudinally spaced apart locations to define the individual sleeve labels therebetween. The severance lines preferably include perforated tear lines on opposite sides of the tubular portion of each label, and perforated tear lines of a different construction on opposite sides of the flaps, the tape, and the release strip. These latter severance lines may comprise continuous cuts so as to facilitate the separation of the individual labels from the continuous tube without skewing during their assembly onto the consumer product.

The sheet of polymeric material is preferably a clear film which is printed on one surface prior to the folding step, and such printing preferably comprises a reverse printing on the portion which becomes the inner surface of the tube and the innermost flap. The portion which becomes the outer surface of the outermost flap can be positively printed. Also, the printed surfaces can be encapsulated and protected by an overlying second clear sheet of polymeric film.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figures 1, 2, 3, 4, 5:
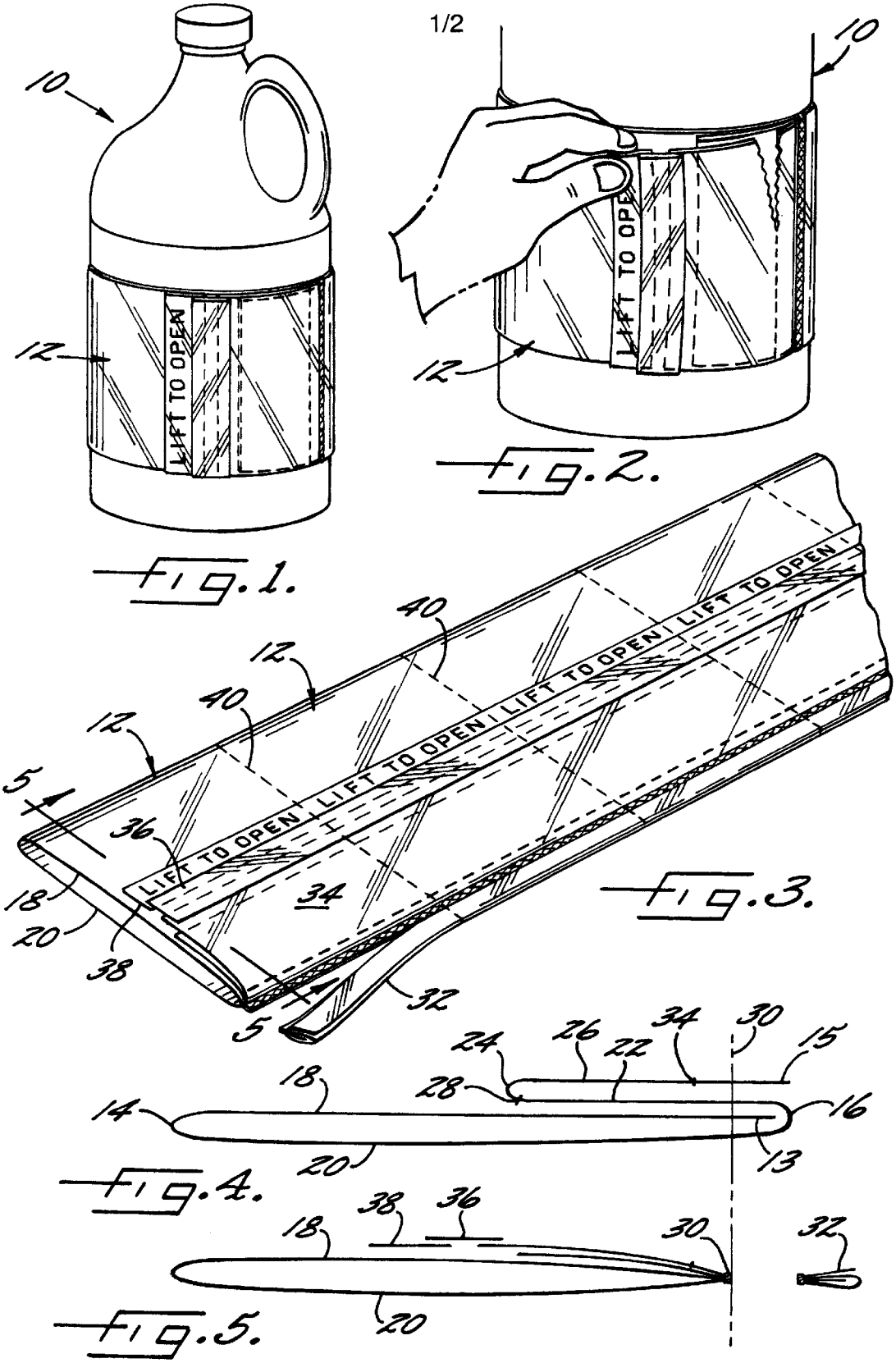
FIG. 1 is a perspective view of a consumer product which comprises a bottle having a sleeve label applied thereto and which embodies the present invention.
FIG. 2 is a fragmentary view of the product shown in FIG. 1 and illustrating the manner in which the outermost flap may be removed from the label.
FIG. 3 is a perspective view of a plurality of sleeve labels at an intermediate stage of their fabrication and prior to being assembled to the consumer product.
FIG. 4 is a schematic cross-sectional view illustrating an initial step in the fabrication of the sleeve label.
FIG. 5 is a view similar to FIG. 4 taken along the line 5—5 of FIG. 2 and also schematically illustrating the assembly of the tape and release strip.

Referring more particularly to the drawings, FIG. 1 illustrates a consumer product in the form of a gallon size plastic bottle or jug 10 which has applied thereto a sleeve label 12 which embodies the present invention. As will be understood as the description proceeds, the sleeve label 12 of the present invention may be applied to a large variety of other consumer products, such as drink sized cans, or rectangular boxes.

The label 12 is fabricated from a sheet of polymeric material, such as low density polyethylene, has first and second opposite side edges 13, 15 which define a longitudinal direction therealong. Also, the label 12 is formed by a method wherein the sheet is initially folded upon itself along first and second parallel longitudinal fold lines 14, 16 which are transversely spaced apart, note FIG. 4.

The two fold lines 14, 16 are folded in the same direction, so as to define an inner layer 18, and a second or bottom layer 20. Also, a third layer 22 is formed on the opposite side of the inner layer 18, and a third fold line 24 is formed in the third layer which is in a direction opposite the direction of the first two fold lines 14, 16. Thus, an outermost portion of the third layer forms a fourth layer 26 which overlies the remainder of the third layer. Also, it will be seen that the described folding operations result in the first and second opposite side edges 13, 15 being generally longitudinally aligned with the second fold line 16.

A longitudinal slit indicated by the line 28 in FIG. 4 is formed in the sheet adjacent the third fold line 24, and the four overlying layers are joined to each other along a longitudinal heat seal line 30 which is parallel to and adjacent the second fold line 16. The heat seal preferably also concurrently slits the layers, to form a small remnant 32 which may be discarded. The resulting structure comprises a tube formed by the first and second layers 18, 20, and two flaps formed by the layers 22, 26 secured to and extending from the seal line 30 in a transverse direction so as to overlie a portion of the tube. The flaps each terminate in a longitudinal outer edge which is transversely spaced from the seal line.

By positioning the slit 28 as illustrated in FIG. 4, the outermost flap 26 defines a longitudinal outer edge which is transversely spaced from the seal line a distance greater than the longitudinal outer edge of the inner flap 22.

A longitudinal perforation 34 line may also be formed in the sheet, preferably prior to the folding operations, and with the line located so as to be immediately adjacent and parallel to the seal line in the outermost flap 26.

As further steps, a tape 36 having a pressure-sensitive adhesive on its bottom surface is placed so as to overlie the outer edge portion of the outermost flap 26, and a release strip 38 is also adhered to a portion of the bottom surface of the tape. Also, as seen in FIG. 5, the central portion of the bottom surface of the tape 36 remains exposed and is positioned to directly engage and adhere to the initial layer 18 of the sheet. The release strip 38, which can have written instructions printed thereon as seen in FIGS. 1–3, permits the easy separation of the outer edge portion of the outermost flap 26 from the inner layer 18 or tube, as seen in FIG. 2.

In a further step, transverse severance lines 40 are formed at longitudinally spaced apart locations along the sheet so as to define a sleeve label 12 between each adjacent pair of severance lines.

The severance lines 40 include perforated tear lines formed of alternating cut and land areas along the two overlying layers 18, 20 which form the opposite side edges of the tube of each label. Also, the severance lines 40 include continuous cut lines, or severance lines of a different cut and land construction, on the opposite sides of the flaps 22, 26, the tape 36, and the release strip 38. More particularly, the construction of the severance lines 40 is designed to facilitate the uniform tearing of the lowermost label from the continuous tube as seen in FIG. 3, as the label is assembled to the consumer product. As will be understood, if the side edges of the flaps 22, 26, tape 36, and release strip 38 were defined by tear lines comparable in cut and land areas to the tear lines defining the tube, there would be non-uniform resistance to the downward pull exerted by the assembly machine, which could in turn result in a skewing of the separated label as it is applied to the product. The severance lines 40 of the flaps 22, 26, tape 36, and release strip 38 are therefore designed to separate more easily than the severance lines 40 of the layers 18, 20 forming the tube. This may be done by forming the severance lines of the flaps, tape, and release strip as continuous cuts, or by tear lines having alternating cut and land areas with larger cuts and shorter land areas as compared to the tear lines of the layers forming the tube.

Figure 6:
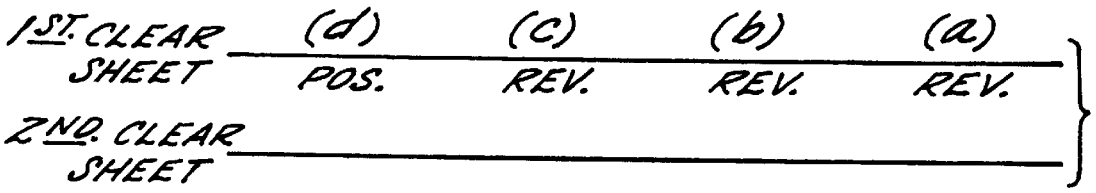
FIG. 6 is a schematic illustration of an optional feature of an embodiment of the method of fabricating the sleeve label of the present invention.
Figure 7:
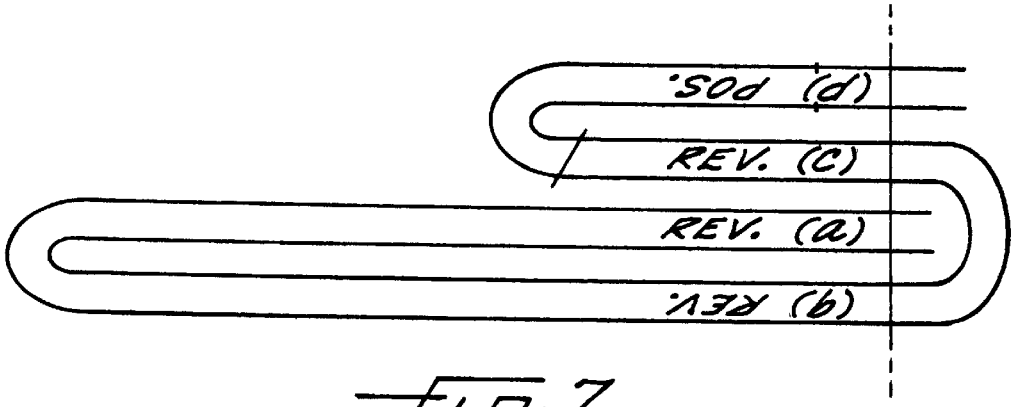
FIG. 7 illustrates a subsequent step in the fabrication method of FIG. 6.

FIGS. 6 and 7 illustrate a specific embodiment of the sleeve label of the present invention, and which is composed of a composite sheet material comprising two overlying film sheets which are transparent, i.e. clear. The initial sheet is preferably printed on one surface, by reverse printing, as indicated at REV. in areas (a), (b), and (c), and positive printing as indicated at POS. in the area (d). The reverse printed areas may if desired be then printed with a flood coating of ink which overlies the reverse printing. The second clear sheet is applied to encapsulate the printing, and the composite sheet is then folded, so that the areas (a), (b), and (c) form the layers 18, 20, 22, respectively, as seen in FIG. 7. As will be apparent, the second clear sheet protects the printing from abrasion and deterioration, and all of the reverse printing is visible through the first clear sheet and from the exterior of the label, when it is assembled to the product. The positive printing is visible through the second clear sheet from the exterior of the label. Also, it will be seen that by lifting the release strip 38, the tape 36 can be released from its engagement with the tube, and the outermost flap 26, then lifted to expose the inner flap 22. The outermost flap 26 can be severed from the label along the perforation line 34 as illustrated in FIG. 2, and can thus serve as a redeemable coupon. The inner flap 22, which is exposed when the outer flap 26 is lifted and removed, provides additional space for receiving detailed product information. Also, the entire circumference of the tube can be exposed when the inner flap 22 is lifted.

While the illustrated embodiment of the sleeve comprises a sleeve label with two outer flaps, it will be understood that additional overlying flaps can be provided by forming additional longitudinal folds during the fabrication process. For example, by providing a fourth fold (not illustrated) in the outermost layer 26 above the second fold line 16 as seen in FIG. 4, an additional overlying flap can be provided, and as other similar fold lines are added with appropriate slits, additional flaps could be formed so as to provide a structure in the nature of a booklet having its flaps or pages joined along the seal line.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims.

Although specific terms are employed herein, they are used in a generic and descriptive sense only and not for purposes of limitation.

That which is claimed is:

1. A method of fabricating a tubular sleeve adapted for use as a sleeve label for a consumer product, comprising the steps of providing a sheet of polymeric material which has first and second opposite side edges which define a longitudinal direction therealong, folding the sheet of polymeric material upon itself along at least first, second, and third parallel longitudinally extending fold lines to form at least four overlying layers of the sheet material, and such that the first and second opposite side edges are generally longitudinally aligned with the second fold line, joining the overlying layers to each other along a longitudinal seal line which is parallel to and adjacent the first and second opposite side edges and the second fold line, and such that the first fold line and the third fold line are transversely spaced from the seal line, and longitudinally slitting the sheet material at a location adjacent the third fold line, whereby two of the overlying layers of the folded sheet material form a tube and another two of the overlying layers of the folded sheet material form two flaps extending transversely from the seal line.

2. The method as defined in claim 1 wherein the two flaps which extend transversely from the seal line overlie each other and define an innermost flap disposed adjacent the tube and an outermost flap disposed on the side of the innermost flap which is opposite the tube, and wherein the method comprises the further step of releasably adhering an outer edge portion of the outermost flap to said tube.

3. The method as defined in claim 2 comprising the further step of locating the slitting step so that the outermost flap extends transversely from the seal line a distance greater than the innermost flap.

4. The method as defined in claim 2 wherein the releasably adhering step includes providing a tape which includes a bottom surface having a pressure sensitive adhesive coating thereon, and pressing the tape onto a portion of the outermost flap so as to extend along an outer edge portion thereof, and so that the outer edge portion of the outermost flap is adhered to a first portion of the bottom surface of the tape, and pressing the tape and the outer edge portion of the outermost flap against the tube so that a second portion of the bottom surface of the tape is adhered to the tube.

5. The method as defined in claim 4 wherein the releasably adhering step further includes adhering a release strip to a third portion of the bottom surface of said tape.

6. A method as defined in claim 1 wherein the folding step includes forming the first and second fold lines so as to be folded in a common direction and so as to form an inner first layer, a second layer on one side of the inner layer, and third layer on the other side of the inner layer, and forming the third fold line in said third layer which is in a direction opposite said common direction so that an outermost portion of the third layer forms a fourth layer overlying the remainder of the third layer.

7. A method of fabricating a plurality of tubular sleeves which are adapted for use as sleeve labels for consumer products, comprising the steps of providing a sheet of polymeric material which has first and second opposite side edges which define a longitudinal direction therealong, folding the sheet of polymeric material upon itself along at least first, second, and third parallel longitudinally extending fold lines to form at least four overlying layers of the sheet material, and such that the first and second opposite side edges are generally longitudinally aligned with the second fold line, joining the overlying layers to each other along a longitudinal seal line which is parallel to and adjacent the first and second opposite side edges and the second fold line, and such that the first fold line and the third fold line are transversely spaced from the seal line, and longitudinally slitting the sheet material at a location adjacent the third fold line, forming transverse severance lines at longitudinally spaced apart locations along the sheet so as to define a sleeve label between each adjacent pair of severance lines, with each sleeve label comprising a tube formed by two of the overlying layers of the folded sheet material and two flaps extending transversely from the seal line formed by another two of the overlying layers.

8. The method as defined in claim 7 wherein the severance lines include perforated tear lines of a predetermined structure along said two overlying layers which form said tube, and perforated tear lines of a structure different from said predetermined structure along said another two overlying layers which form said overlying flaps.

9. The method as defined in claim 7 wherein the severance lines include perforated tear lines of a predetermined structure along said two overlying layers which form said tube, and continuous cut lines along said another two overlying layers which form said overlying flaps.

10. The method as defined in claim 7 wherein the two flaps which extend transversely from the seal line overlie each other and define an innermost flap disposed adjacent the tube and an outermost flap disposed on the side of the innermost flap which is opposite the tube.

11. The method as defined in claim 10 wherein the sheet of polymeric material is clear and defines an inner surface and an outer surface, and wherein the method comprises prior to the folding step, the further step of reverse printing indicia on the inner surface of a portion of the sheet which forms the tube and the innermost one of the two overlying flaps, and positively printing indicia on the inner surface of a portion of the sheet forming the outermost flap.

12. The method as defined in claim 11 comprising, subsequent to the printing steps and prior to the folding step, the further step of applying a clear sheet of polymeric material over the printed inner surface of the first mentioned sheet of polymeric material, so as to encapsulate the printing.

* * * * *